US009797691B1

(12) United States Patent
Hunn et al.

(10) Patent No.: US 9,797,691 B1
(45) Date of Patent: Oct. 24, 2017

(54) CERAMIC ARMOR BUFFERS FOR ENHANCED BALLISTIC PERFORMANCE

(71) Applicant: Lockheed Martin Corporation, Bethesda, MD (US)

(72) Inventors: David L. Hunn, Kennedale, TX (US); Sang J. Lee, Coppell, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 257 days.

(21) Appl. No.: 14/531,439

(22) Filed: Nov. 3, 2014

(51) Int. Cl.
*F41H 7/00* (2006.01)
*F41H 5/04* (2006.01)

(52) U.S. Cl.
CPC ..... *F41H 5/0421* (2013.01); *F41H 7/00* (2013.01)

(58) Field of Classification Search
USPC ..... 89/36.01, 36.02; 428/332, 472, 469
See application file for complete search history.

(56) References Cited

U.S. PATENT DOCUMENTS

| | | | | |
|---|---|---|---|---|
| 3,573,150 | A | 3/1971 | Broutman et al. | |
| 4,404,889 | A | 9/1983 | Miguel | |
| 4,566,237 | A | 1/1986 | Turner | |
| 4,836,084 | A | 6/1989 | Vogelesang et al. | |
| 5,577,432 | A | 11/1996 | Becker et al. | |
| 5,654,518 | A * | 8/1997 | Dobbs | F41H 5/0457 89/36.02 |
| 5,804,757 | A | 9/1998 | Wynne | |
| 5,833,782 | A | 11/1998 | Crane et al. | |
| 6,418,832 | B1 | 7/2002 | Colvin | |
| 6,681,679 | B2 | 1/2004 | Vives et al. | |
| 6,758,125 | B1 | 7/2004 | Zank | |
| 6,860,186 | B2 | 3/2005 | Cohen | |
| 7,383,762 | B2 | 6/2008 | Cohen | |
| 7,540,229 | B2 | 6/2009 | Seo et al. | |
| 7,546,796 | B2 | 6/2009 | Hunn | |
| 7,585,043 | B2 | 9/2009 | Adkins et al. | |
| 7,874,239 | B2 | 1/2011 | Howland | |
| 8,099,791 | B1 | 1/2012 | Adkins et al. | |
| 8,491,835 | B2 | 7/2013 | Schmidt | |
| 2003/0164087 | A1 | 9/2003 | Vives et al. | |
| 2004/0050239 | A1 | 3/2004 | Benyami et al. | |

(Continued)

FOREIGN PATENT DOCUMENTS

| | | |
|---|---|---|
| DE | 4005904 | * 8/1991 |
| EP | 1985961 | * 10/2008 |

(Continued)

OTHER PUBLICATIONS

Abramshe, Ron, "Improving Ceramic Armor Performance with Better Materials," Oct. 1, 2006, Ceramic Industry, http://www.ceramicindustry.com/articles/88189-improving-ceramic-armor-performance-with-better-materials, 5 pages.

(Continued)

*Primary Examiner* — Archene Turner
(74) *Attorney, Agent, or Firm* — Withrow & Terranova, PLLC

(57) ABSTRACT

An armor component having a plurality of ceramic elements, where each ceramic element is covered by a metal coating. Each metal coating covers the outer surface of only one ceramic element. The metal coating is configured to increase a dwell time for the armor component when the armor component is impacted by a projectile.

10 Claims, 7 Drawing Sheets

(56) References Cited

U.S. PATENT DOCUMENTS

| | | | | |
|---|---|---|---|---|
| 2004/0083880 | A1 | 5/2004 | Cohen | |
| 2006/0243127 | A1 | 11/2006 | Cohen | |
| 2006/0266207 | A1 | 11/2006 | Cerny et al. | |
| 2007/0283801 | A1 | 12/2007 | Gallo | |
| 2008/0011153 | A1* | 1/2008 | MacDonald ..... | F41H 1/02 89/36.01 |
| 2008/0104735 | A1 | 5/2008 | Howland | |
| 2011/0107904 | A1 | 5/2011 | Queheillalt et al. | |
| 2012/0125187 | A1 | 5/2012 | Hunn | |
| 2012/0132064 | A1 | 5/2012 | Hunn et al. | |
| 2013/0263727 | A1 | 10/2013 | O'Masta et al. | |
| 2013/0263728 | A1 | 10/2013 | Hebensperger et al. | |

FOREIGN PATENT DOCUMENTS

| | | | |
|---|---|---|---|
| EP | 2008051 | B1 | 11/2013 |
| WO | 2010039321 | A2 | 4/2010 |
| WO | 2011005275 | A1 | 1/2011 |
| WO | 2014016573 | A1 | 1/2014 |
| WO | 2014023309 | A1 | 2/2014 |

OTHER PUBLICATIONS

Holmquist, Timothy J. et al., "Modeling prestressed ceramic and its effect on ballistic performance," International Journal of Impact Engineering, vol. 31, Issue 2, Feb. 2005, Elsevier Ltd., pp. 113-127.
Non-Final Office Action for U.S. Appl. No. 13/670,092, mailed May 29, 2014, 7 pages.
Final Office Action for U.S. Appl. No. 13/670,092, mailed Sep. 5, 2014, 8 pages.

* cited by examiner

CERAMIC ARMOR BUFFERS FOR ENHANCED BALLISTIC PERFORMANCE

RELATED APPLICATIONS

This application is related to U.S. patent application Ser. No. 13/670,092, filed on Nov. 6, 2012, entitled "SEGMENTED CERAMIC BAR ARMOR," which claims priority to U.S. Provisional Patent Application No. 61/556,476, filed on Nov. 7, 2011, entitled "SEGMENTED CERAMIC BAR ARMOR," and is also related to U.S. Provisional Patent Application No. 61/556,494, filed on Nov. 7, 2011, entitled "CERAMIC ARMOR BUFFERS FOR ENHANCED BALLISTIC PERFORMANCE," the disclosures of each of which are hereby incorporated herein by reference in their entireties.

TECHNICAL FIELD

The embodiments relate generally to a ceramic buffer having a metallic coating, and more particularly to a ceramic buffer used as a core in armor to protect a vehicle from ballistic impact.

BACKGROUND

As the mass of a particular vehicle (air, ground, or water) increases, the efficiency and agility of the vehicle decreases. Therefore, it is desirable to limit the masses of vehicles in order to increase the efficiency and agility of the vehicles. Accordingly, in armored vehicles, i.e. vehicles that have protection against projectiles, the desire to limit the vehicles' masses conflicts with the desire to provide protection against ballistic impact. Therefore, it is desirable to develop armors that are both lightweight and provide sufficient protection against projectiles.

Many armor systems use hard ceramic materials as part of ballistic protection. Ceramics have the advantage of being both lightweight and hard. However, one disadvantage of ceramic materials is that ceramic materials are often brittle and susceptible to premature failure and cracking when struck by a projectile. This cracking occurs due to shock waves that travel through the ceramic during an initial impact. Accordingly, there is a need for mechanisms for reducing or modifying the initial shock waves in order to improve the performance of ceramic armor.

SUMMARY

The embodiments relate to armor components comprising a ceramic element having a metal coating.

In one embodiment, an armor component comprises a plurality of ceramic elements having an outer surface, and a plurality of metal coatings with each of the metal coatings covering a portion of the outer surface of a respective ceramic element. The metal coating is configured to increase a dwell time of the armor component. The metal coating comprises a metal foil, a metal layer, or a spray coating that is approximately 0.5 mm to 5 mm in thickness. The metal coating comprises one of copper, gold, silver, lead, or tungsten.

The ceramic element can be any shape suitable for use in armor. By way of non-limiting example, the ceramic element may be one of a disc shape, tile shape, plate shape, cylindrical shape, prismatic shape, or spherical shape. In one embodiment, the metal coating comprises a metal having a high impedance to sound. By way of non-limiting example, the metal coating may comprise copper, gold, tungsten, silver, and lead, or a metal alloy.

In another embodiment, an armor component comprises a strike face sheet, a rear face sheet, and a core disposed between the strike face sheet and the rear face sheet. The core comprises a plurality of discrete ceramic elements, each of the ceramic elements having an outer surface that is substantially covered by a metal coating, wherein the metal coating is configured to increase a dwell time of the outer surface of the ceramic element.

In another embodiment, a vehicle comprises an outer hull. The outer hull comprises a strike face sheet, a rear face sheet, and a core disposed between the strike face sheet and the rear face sheet that comprises a plurality of discrete ceramic elements. Each of the ceramic elements has an outer surface that is substantially covered by a metal coating that is configured to increase a dwell time of the outer surface of the ceramic element. The vehicle may comprise, for example, a land vehicle, an air vehicle, or a water vehicle.

In another embodiment, a method of manufacturing an armor component is provided. A plurality of ceramic elements is provided. The outer surface of each ceramic element is covered with an individual metal coating. The plurality of ceramic elements is bonded together to form a ceramic layer. A strike face sheet and a rear face sheet are provided, and the ceramic layer is bonded to the strike face sheet and the rear face sheet.

Those skilled in the art will appreciate the scope of the disclosure and realize additional aspects thereof after reading the following detailed description of the preferred embodiments in association with the accompanying drawing figures.

BRIEF DESCRIPTION OF THE DRAWINGS

The accompanying drawing figures incorporated in and forming a part of this specification illustrate several aspects of the disclosure, and together with the description serve to explain the principles of the disclosure.

DETAILED DESCRIPTION

Figure 1A:
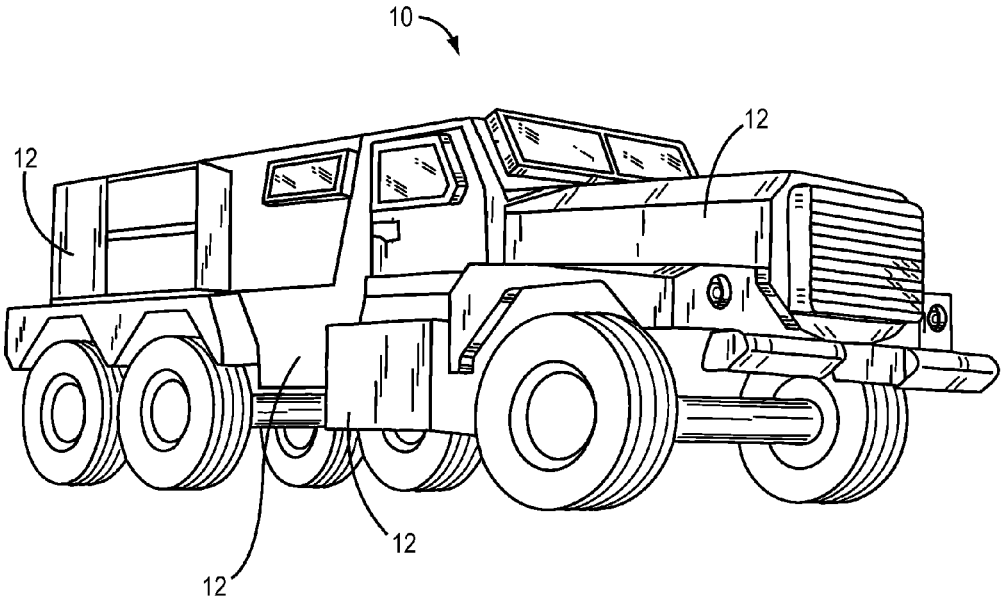
FIG. 1A is a perspective view illustrating an armored ground vehicle.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Any flowcharts discussed herein are necessarily discussed in some sequence for purposes of illustration, but unless otherwise explicitly indicated, the embodiments are not limited to any particular sequence of steps. The use herein of ordinals in conjunction with an element is solely for distinguishing what might otherwise be similar or identical labels, such as "first shock wave" and "second shock wave," and does not imply a priority, a type, an importance, or other attribute, unless otherwise stated herein. The term "about" used herein in conjunction with a numeric value means any value that is within a range of ten percent greater than or ten percent less than the numeric value. The terms "provided" and "providing" are used herein only to signify that an item is obtained or present. The terms "provided" and "providing" are not used to imply that one party or entity "provides" an item to another party or entity.

Conventional armored vehicles strike a balance between providing sufficient protection against ballistic strikes and minimizing the weight of the respective armored vehicle. In order to achieve this balance, armor components have been designed that include ceramic materials. Ceramic materials are utilized in armor because armors having a ceramic core typically weigh less than armors having a metal core. Additionally, many ceramic armors are comprised of a plurality of discrete ceramic elements (prisms, balls, hexagons, squares, cylinders, and rods) that are bonded together to improve the multi-strike capability of the respective armor relative to armors comprised of large single plates of ceramic materials. Typically, armors comprised of a plurality of ceramic elements will not perform near to a theoretically possible level because of premature failure of the ceramic elements due to impact shock stresses and shock reflections that occur during the initial impact event. These shock stresses and shock reflections often cause premature cracking of the ceramic elements leading to a lower ballistic protection than expected. Generally, ceramic materials are very strong in compression and relatively weak in tension. Ceramic materials are also very brittle. The period of time from when a projectile impacts armor to when the projectile starts to penetrate the surface of the armor is known as dwell time. In armor systems, an infinite dwell time occurs when a high velocity projectile impacts a target and the projectile flows out radially (dwells) on the surface of the target with no significant penetration of the target. If dwell time can be sustained, the ceramic armor achieves near theoretical protection limits. When a ceramic core can no longer support a load applied by a penetrator, the armor fails, and penetration begins.

The embodiments described herein promote dwell time, reduce peak stresses, and reduce shock reflections for discrete ceramic elements and can be applied directly on individual ceramic elements as thin metal foils, metal layers, or spray coatings. According to one embodiment, providing a coating directly on individual ceramic elements results in a buffering mechanism for the individual ceramic elements that promotes increasing the dwell time of the armor by reducing an impact shock caused by a projectile, and that provides ramp stress loading to the individual ceramic elements to reduce reflected shocks. Analytical studies and subsequent test results show that buffer mechanims based on metals, such as copper, gold, tungsten, silver, and lead, provide the characteristics needed to delay early failure of a ceramic core and promote significantly improved ballistic protection.

Figure 1B:
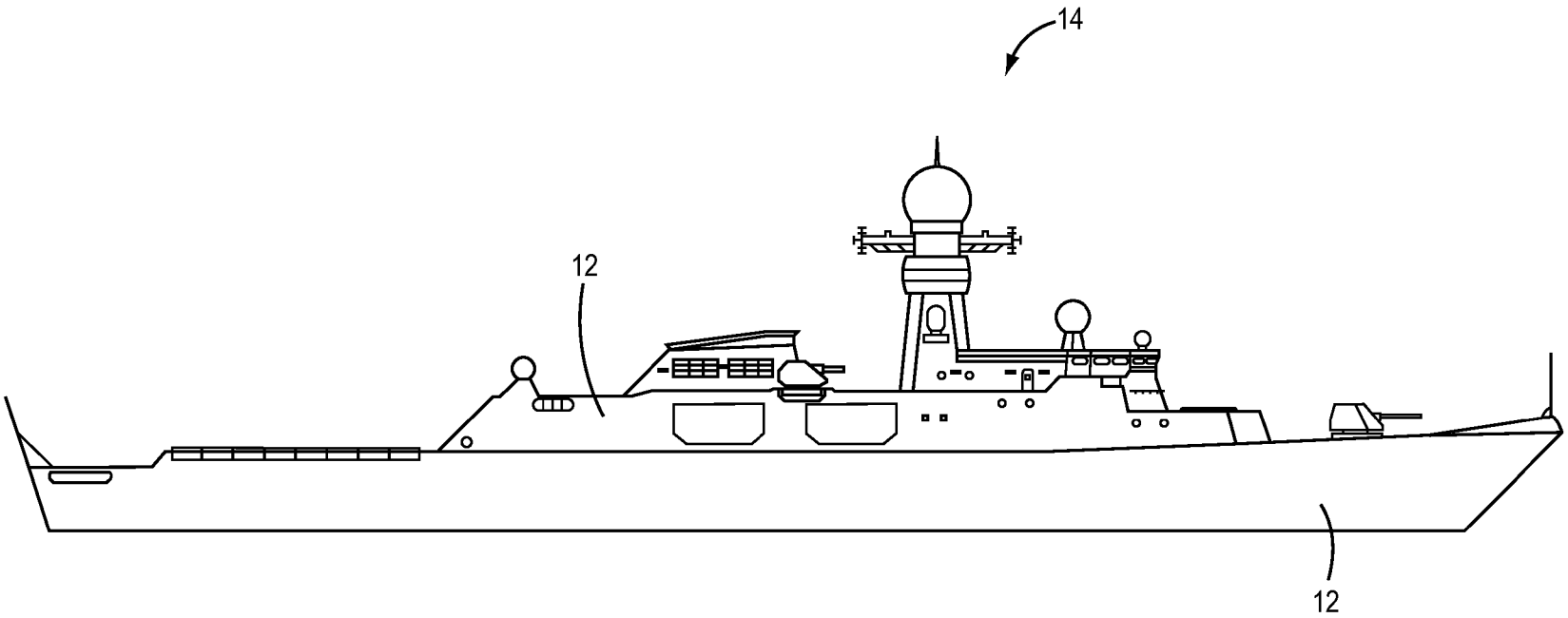
FIG. 1B illustrates an armored water vehicle.

FIG. 1A is a perspective view illustrating an armored land vehicle 10 having a plurality of armor components 12 protecting a hull, or outer surface, of the land vehicle 10. The plurality of armor components 12 can be located on any outer surface of the land vehicle 10, and an individual armor component 12 may cover a large continuous area. Although the land vehicle 10 is depicted as a vehicle having wheels, it could be any armored land vehicle, including but not limited to a tank, an armored truck, or an armored car. FIG. 1B illustrates an armored water vehicle 14, such as a ship or a boat, having the armor component 12 protecting a hull, or an outer surface, of the water vehicle 14. In both the land vehicle 10 and the water vehicle 14, any portion of the outer surface may be protected by the respective armor component 12.

In one embodiment, the armor component 12 is a ballistic armor having a prismatic, tessellated core. The core comprises a plurality of ceramic elements. The layers of ceramic elements are separated from one another by strain isolation layers. In one embodiment, the ceramic elements are prismatic and arranged so that faces of the ceramic elements in adjacent layers of the ceramic elements, separated by the strain isolation layer, are in facing, nested relationships with one another. The armor component 12 further includes a strike face sheet and a rear face sheet, so that the core is disposed between the strike face sheet and the rear face sheet. In some embodiments, the armor component 12 further includes a viscoelastic layer disposed between the core and the strike face sheet and/or a viscoelastic layer disposed between the core and the rear face sheet.

Figure 2:
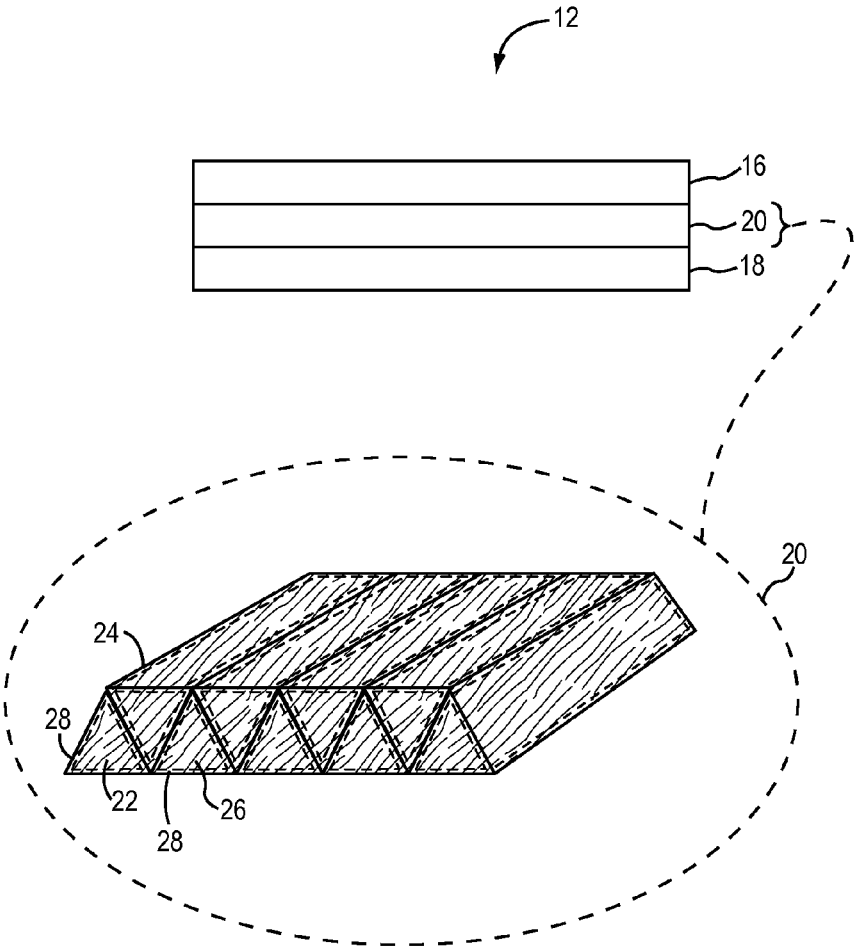
FIG. 2 illustrates a cross-section of an armor component.

FIG. 2 illustrates a cross-section of the armor component 12 in greater detail. The armor component 12 comprises a strike face sheet 16, a rear face sheet 18, and a core 20 disposed between the strike face sheet 16 and the rear face sheet 18.

The strike face sheet 16 comprises a material that will, to some degree, substantially impede the progress of a projectile. By way of non-limiting example, the strike face sheet 16 may comprise steel; a steel alloy; titanium; a titanium alloy; aluminum; an aluminum alloy; an organic-matrix composite material, such as, for example, graphite-, carbon-, aramid-, para-aramid-, ultra-high molecular weight polyethylene- or fiberglass-reinforced epoxy composite material; a metal-matrix composite material, such as carbon-, silicon carbide-, or boron-reinforced titanium or aluminum composite material; a laminated material, such as titanium/aluminum laminate; or a similar material.

The rear face sheet 18 comprises a material that will significantly reduce the velocity of spall (e.g., projectile fragments, fragments of the armor component 12, or similar fragments) exiting the armor component 12. More preferably, the rear face sheet 18 comprises a material that will substantially prevent such spall from exiting the armor component 12. By way of non-limiting example, the rear face sheet 18 may comprise one of the materials disclosed above of which the strike face sheet 16 is composed.

However, the particular compositions of the strike face sheet 16 and the rear face sheet 18 are implementation specific. Accordingly, the strike face sheet 16 and the rear face sheet 18 may comprise any material suitable for a particular implementation. Moreover, the thicknesses of the strike face sheet 16 and the rear face sheet 18 are also implementation specific, depending upon the respective ballistic threat. In one embodiment, the thickness of the strike face sheet 16 is about 0.09 inches and the thickness of the rear face sheet 18 is about 0.75 inches. Generally, it is often, but not always, desirable for the rear face sheet 18 to be thicker than the strike face sheet 16.

The core 20 comprises a plurality of ceramic elements 22, 24, and 26. The ceramic elements 22, 24, and 26 may comprise various ceramic, glass, glass-ceramic, or glass-like materials, even within the same armor component 12. Exemplary ceramic materials include, but are not limited to, aluminum oxide, silicon carbide, boron carbide, silicon nitride, aluminum oxynitride, or similar materials. In some embodiments, the ceramic elements 22, 24, and 26 comprise aluminum oxide, as aluminum oxide is generally lower in cost than many other ceramic materials. Each of the ceramic elements 22, 24, and 26 has an outer surface comprising five surfaces. In one embodiment, each of the five surfaces is covered by a respective metal coating 28 that provides the buffering feature. In another embodiment, the three largest surfaces are covered by the metal coating 28, which provides the buffering feature, while the two end surfaces are not covered. The metal coating 28 will be described in more detail below.

Figure 3:
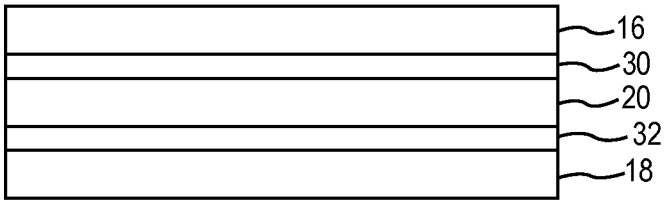
FIG. 3 is a block diagram illustrating another embodiment of an armor component.

FIG. 3 is a block diagram illustrating another embodiment of the armor component 12. A first viscoelastic layer 30 is disposed between the core 20 and the strike face sheet 16. A second viscoelastic layer 32 is disposed between the core 20 and the rear face sheet 18. In other embodiments, one or both of the viscoelastic layers 30, 32 may be omitted from the armor component 12.

The viscoelastic layers 30, 32 are made of one or more viscoelastic materials. For the purposes of this disclosure, the term "viscoelastic" means the exhibition of both elastic and viscous properties that are demonstrable in response to mechanical shear. Preferably, the viscoelastic layers 30, 32 comprise materials such as polyurethane, polysulfide polymer, natural rubber, silicone rubber, a synthetic rubber, similar materials, or a combination of these or similar materials. The viscoelastic layers 30, 32 attenuate the shock wave that travels through the armor component 12 upon impact by a projectile, which improves the overall efficiency in withstanding impact from a projectile. Additionally, the viscoelastic layers 30, 32 constrain and bond the ceramic elements 22, 24, and 26 together to inhibit the ceramic elements 22, 24, and 26 from becoming dislodged during use. If no viscoelastic material is used, then a suitable bonding agent can be used, such as epoxy, polysulfide, or a similar material.

Figure 4A:
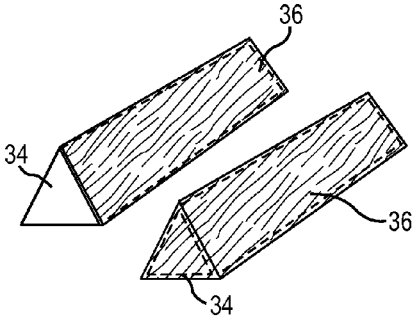
FIGS. 4A-4E are perspective views illustrating examples of ceramic components utilizable in armor.

FIGS. 4A-4E are perspective views illustrating various shapes for ceramic elements suitable for armor. These shapes are for exemplary purposes only, and any suitably shaped ceramic element can be used. FIG. 4A illustrates a prismatic ceramic element 34. The prismatic ceramic element 34 is covered by a metal coating 36. In one embodiment, three outer surfaces of the prismatic ceramic element 34 are covered by the metal coating 36. In another embodiment, four of the outer surfaces of the prismatic ceramic element 34 are covered by the metal coating 36. In another embodiment, all five of the outer surfaces of the prismatic ceramic element 34 are covered by the metal coating 36.

Figure 4B:
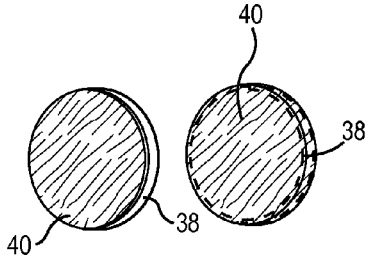

FIG. 4B illustrates a disc-shaped (or button-shaped) ceramic element 38 covered by a metal coating 40. In one embodiment, only one surface of the disc-shaped ceramic element 38 is covered by the metal coating 40. In another embodiment, both sides of the disc-shaped ceramic element 38 are covered by the metal coating 40. In another embodiment, all of the outer surfaces of the disc-shaped ceramic element 38 are covered by the metal coating 40.

Figure 4C:
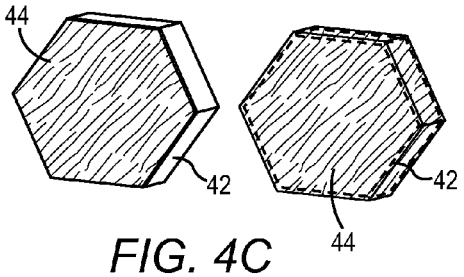

FIG. 4C illustrates a hexagonal ceramic element 42 covered by a metal coating 44. In one embodiment, only one surface of the hexagonal ceramic element 42 is covered by the metal coating 44. In another embodiment, two surfaces of the hexagonal ceramic element 42 are covered by the metal coating 44. In another embodiment, all of the outer surfaces of the hexagonal ceramic element 42 are covered by the metal coating 44.

Figure 4D:
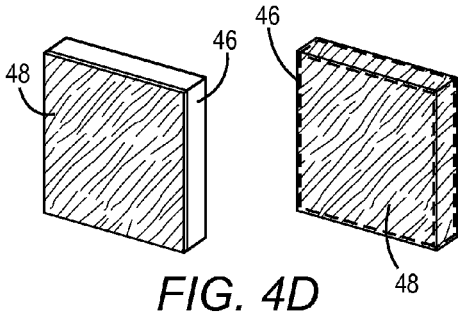

FIG. 4D illustrates a plate-shaped ceramic element 46 covered by a metal coating 48. In one embodiment, only one surface of the plate-shaped ceramic element 46 is covered by the metal coating 48. In another embodiment, two surfaces of the plate-shaped ceramic element 46 are covered by the metal coating 48. In another embodiment, all of the outer surfaces of the plate-shaped ceramic element 46 are covered by the metal coating 48.

Figure 4E:
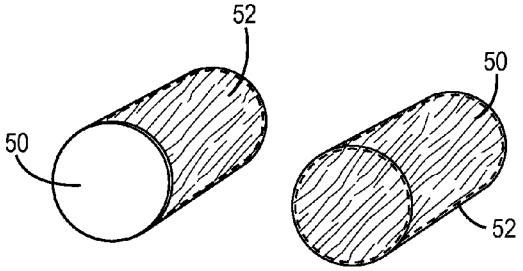

FIG. 4E illustrates a cylindrical ceramic element 50 covered by a metal coating 52. In one embodiment, the body of the cylindrical ceramic element 50 is covered by the metal coating 52, but neither end of the cylindrical ceramic element 50 is covered by the metal coating 52. In another embodiment, the body and one end of the cylindrical ceramic element 50 are covered by the metal coating 52. In another embodiment, the body and both ends of the cylindrical ceramic element 50 are covered by the metal coating 52.

Figure 5:
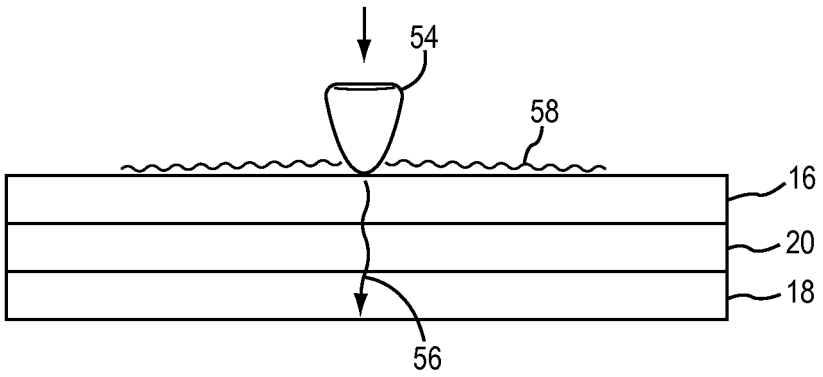
FIG. 5 is a block diagram illustrating a projectile impacting an armor component.

FIG. 5 is a block diagram illustrating a projectile 54 impacting an armor component 12. When the projectile 54 impacts the strike face sheet 16, a first shock wave 56 travels through the armor component 12, while a second shock wave 58 travels along the surface of the armor component 12. The first shock wave 56 penetrates the core 20 of the armor component 12 and reflects off of the rear face sheet 18 back into the core 20 of the armor component 12. The first shock wave 56 causes stress on the ceramic elements in the core 20, often resulting in premature failure of the armor component 12. Once the ceramic elements have failed, the armor is weakened, and the projectile 54 may penetrate the strike face sheet 16. The period of time from when the projectile 54 impacts the armor to when the projectile 54 starts to penetrate the surface of the armor component 12 is known as the dwell time. It is therefore desirable to minimize the damage caused by the first shock wave 56 traveling through the armor component 12 without greatly increasing the cost or the weight of the armor component 12.

An armor having a core comprising very thick ceramic elements has a high dwell time. However, the thickness of the ceramic elements increases the weight and cost of the armor, making it unsuitable for most applications. An armor having a core comprising thinner ceramic elements that are typically used in current applications generally has a low dwell time. This low dwell time is caused by the brittle nature of ceramics, which sustain microfractures from reflected shock waves. When the ceramic elements crack, the core 20 can no longer support the force applied by the ballistic impact, and penetration of the armor occurs. It is therefore desirable to increase the dwell time of armor by minimizing the damage caused by shock waves propagating through the armor, without greatly increasing the cost or the weight of the armor.

Referring back to FIG. 2, it has been found that covering the surfaces of the ceramic elements 22, 24, and 26 with a layer of metal greatly reduces the stress caused by the propagation of shock waves. As previously stated, the ceramic elements 22, 24, and 26 each have five outer surfaces. Each of the outer surfaces is covered with the metal coating 28. The metal coating 28 may be applied by a spray coating or by adhering a metal foil or thin metal layer to the outer surfaces. In one embodiment, all of the outer surfaces of each ceramic element 22, 24, and 26 are covered by the metal coating 28. In another embodiment, the end surfaces of the ceramic elements 22, 24, and 26 are not covered by the metal coating 28. In another embodiment, the majority of each outer surface is covered by the metal coating 28, but not the entirety of each outer surface.

The metal coatings 28 are comprised of metals that have characteristics that are suggested by the Tate equation for ballistic resistance and by the Johnson-Holmquist (JH) material models for impact resistance. The Tate equation can be presented as:

$$R_T = \tfrac{1}{2}\rho_P v_P^2 + Y_P$$

where:

$R_T$ is the target strength;

$\rho_P$ is the density of the penetrator (e.g. projectile);

$v_P^2$ is the velocity of the penetrator; and $Y_P$ is the penetrator strength.

The JH model assumes that the material is initially elastic and isotropic and can be described by a relation of the form (summation is implied over repeated indices):

$$\sigma_{ij} = -p(\epsilon_{kk})\delta_{ij} + 2\mu\epsilon_{ij}$$

where:

$\sigma_{ij}$ is a stress measure;

$p(\epsilon_{kk})$ is an equation of state for the pressure;

$\delta_{ij}$ is the Kronecker delta;

$\epsilon_{ij}$ is a strain measure that is energy conjugate to $\sigma_{ij}$; and $\mu$ is a shear modulus. The quantity $\epsilon_{kk}$ is frequently replaced by the compression $\xi$ so that the equation of state is expressed as:

$$p(\xi) = p(\xi(\epsilon_{kk})) = p\left(\frac{\rho}{\rho_0} - 1\right); \xi := \frac{\rho}{\rho_0} - 1$$

where p is the current mass density and $\rho_0$ is the initial mass density.

The stress at the interface is assumed to be given by a relation of the form:

$$\sigma_h = \mathcal{H}(\rho, \mu) = p_{HEL}(\rho) + \frac{2}{3}\sigma_{HEL}(\rho, \mu)$$

where $p_{HEL}$ is the pressure at the Hugoniot elastic limit (Hel) and $\sigma_{HEL}$ is the stress at the Hel. The Hel is the point on the shock Hugoniot at which a material transitions from a purely elastic state to an elastic-plastic state.

The metal coating 28 may comprise any suitable metal, such as copper, gold, tungsten, silver, lead, or any other suitable metal. Suitable metals are metals that meet the factors described above and are typically metals that have a high resistance to shock waves, low sonic velocity, and are readily formable.

In one embodiment, the metal coating 28 may be applied by spray-coating the surfaces of the ceramic elements. In another embodiment, the metal coating 28 comprises a foil, and the foil is adhered to the respective ceramic element using a suitable adhesive or epoxy. Metals can be applied as foils, as plasma, as flame-sprayed or sputtered coatings, as cold isostatically pressed enclosures, or by other means that encapsulate the respective ceramic element. Coatings and foils are two different ways to apply the metals. The class of metals of interest includes metals that exhibit high plasticity, low sonic velocity, and moderate strength.

The metal coating 28 must be a thickness that is suitable to improve the resistance to shock waves without being so thick as to greatly increase the weight of the armor. In one embodiment, the metal coating 28 is at least approximately 0.5 mm in thickness. In another embodiment, the metal coating 28 is no more than approximately 5 mm in thickness. The thickness of the metal coating 28 can fall within 0.5 mm-5 mm based on the desired performance, the type of ceramic material being coated, and the properties of the particular metal used. However, any desirable thickness can be used.

The metal coating 28 may be used with any shaped ceramic element. For example, the disc-shaped ceramic element 38 can have the metal coating 40 on one or both surfaces. The hexagonal ceramic element 42 may have the metal coating 44 on any or all of its eight surfaces. The plate-shaped ceramic element 46 may have the metal coating 48 on any or all of its six surfaces. The cylindrical ceramic element 50 may be covered by a metal sleeve, sprayed by a metal coating, or dipped in a metal coating to have a metal coating 52 on any or all of its three surfaces.

Utilizing an armor component having ceramic elements with metal coatings results in an armor component that has a substantially increased dwell time. For example, a first ceramic plate was impacted by a projectile traveling at 6500 feet per second (fps). The projectile penetrated the ceramic plate in 1.5 μs. A second ceramic plate was covered with a copper foil and impacted by a similar projectile traveling at 6500 fps. The projectile penetrated the second ceramic plate that was covered with the copper foil in 3 μs, which is twice as long as the time it took to penetrate the first ceramic plate that was not covered.

In another example, a first prismatic ceramic element was impacted by a .30 caliber projectile traveling at a speed of 2800 fps. A second prismatic ceramic element was coated on three surfaces with a copper coating 2 mm in thickness. A third prismatic ceramic element was coated on all of its outer surfaces with a copper coating 1.5 mm in thickness. Both the second prismatic ceramic element and the third prismatic ceramic element had almost a 50% improvement in response to the projectile compared to the first prismatic ceramic element.

Figure 6:
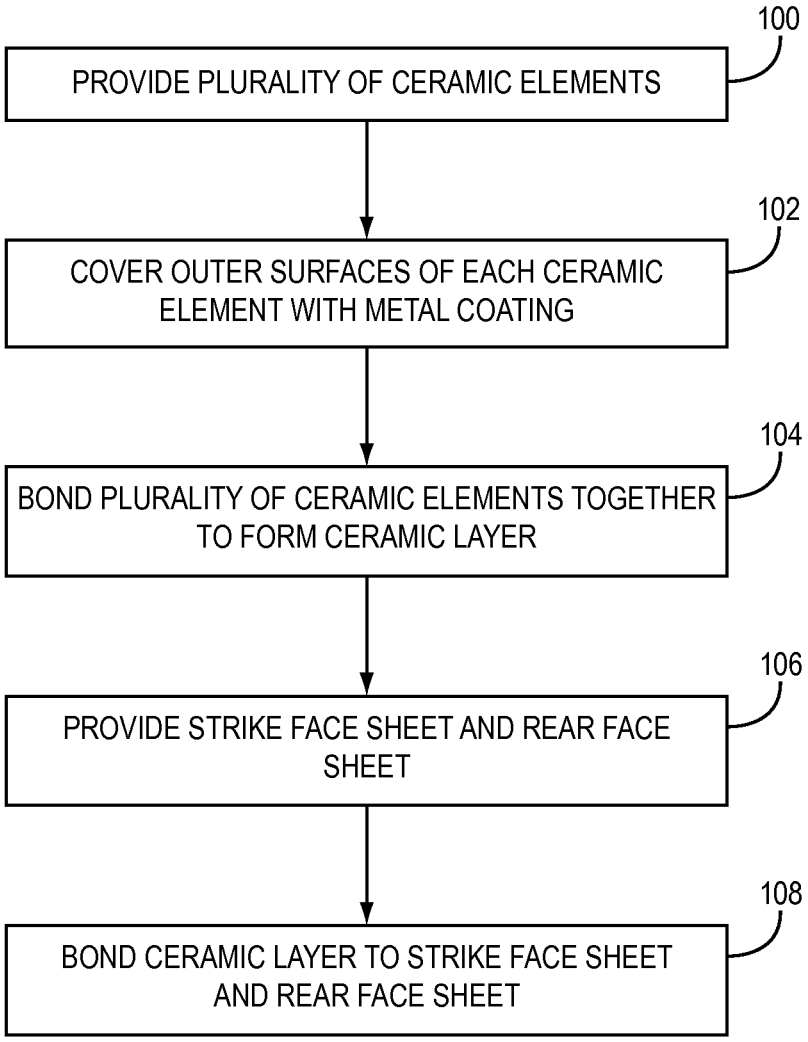
FIG. 6 is a flowchart of a method of manufacturing an armor component.

FIG. 6 is a flowchart illustrating a method of manufacturing an armor component 12. A plurality of ceramic elements is provided (block 100). At least one outer surface of each ceramic element of the plurality of ceramic elements is covered by a metal coating of a plurality of metal coatings (block 102). The plurality of ceramic elements is bonded together to form a ceramic layer (block 104). A strike face sheet and a rear face sheet are provided (block 106). One side of the ceramic layer is bonded to the strike face sheet and another side of the ceramic layer is bonded to the rear face sheet (block 108).

In one embodiment, bonding the plurality of ceramic elements together to form the ceramic layer includes providing a plurality of strain isolation layers and bonding the ceramic elements together using the plurality of strain isolation layers.

In one embodiment, bonding the ceramic layer to the strike face sheet and the rear face sheet includes providing a first viscoelastic layer and a second viscoelastic layer. A first side of the ceramic layer is bonded to the first viscoelastic layer and a second side of the ceramic layer is bonded to the second viscoelastic layer. The first side of the ceramic layer and the first viscoelastic layer are bonded to the strike face sheet. The second side of the ceramic layer and the second viscoelastic layer are bonded to the rear face sheet.

Those skilled in the art will recognize improvements and modifications to the preferred embodiments of the disclosure. All such improvements and modifications are considered within the scope of the concepts disclosed herein and the claims that follow.

What is claimed is:

1. An armor component, comprising:

a plurality of ceramic elements, wherein each ceramic element of the plurality of ceramic elements has an outer surface; and a plurality of metal coatings, wherein each metal coating of the plurality of metal coatings covers each outer surface of a respective ceramic element of the plurality of ceramic elements, wherein each metal coating is configured to increase a dwell time of the armor component.

2. The armor component of claim 1, wherein at least one metal coating of the plurality of metal coatings comprises a metal foil.

3. The armor component of claim 1, wherein at least one metal coating of the plurality of metal coatings comprises one of copper, gold, silver, lead, or tungsten.

4. The armor component of claim 1, wherein at least one metal coating of the plurality of metal coatings comprises a sprayed coating.

5. The armor component of claim 1, wherein at least one metal coating of the plurality of metal coatings has a thickness that is substantially equal to or less than 5 mm and the thickness is substantially equal to or greater than 0.5 mm.

6. The armor component of claim 1, wherein at least one ceramic element of the plurality of ceramic elements is substantially disc-shaped or substantially plate-shaped.

7. The armor component of claim 1, wherein at least one ceramic element of the plurality of ceramic elements is substantially cylindrical.

8. The armor component of claim 1, wherein at least one ceramic element of the plurality of ceramic elements is substantially prism-shaped.

9. The armor component of claim 1 further comprising:

a strike face plate mounted onto the plurality of ceramic elements.

10. The armor component of claim 1, wherein each metal coating covers a majority of the outer surface of the respective ceramic element.

* * * * *